US005562032A

United States Patent [19]

Hasegawa et al.

[11] Patent Number: 5,562,032

[45] Date of Patent: Oct. 8, 1996

[54] CORRUGATED BOARD SHEET TRANSPORTING SYSTEM IN PRINTING LINE

[75] Inventors: Kazumi Hasegawa, Komaki; Shunji Kato, Kasugai, both of Japan

[73] Assignee: Kabushiki Kaisha Isowa, Aichi, Japan

[21] Appl. No.: 346,412

[22] Filed: Dec. 6, 1993

[51] Int. Cl.[6] ..... B41F 13/24

[52] U.S. Cl. ..... 101/232; 271/272; 400/635

[58] Field of Search ..... 101/232, 233, 101/234; 400/635; 271/7, 198, 200, 272, 273, 274

[56] References Cited

U.S. PATENT DOCUMENTS

| | | | |
|---|---|---|---|
| 4,566,014 | 1/1986 | Paranjpe et al. | 101/232 |
| 4,697,944 | 10/1987 | Peebles et al. | 400/635 |
| 5,150,652 | 9/1992 | Yamamoto et al. | 101/232 |
| 5,265,867 | 11/1993 | Magee | 271/272 |

FOREIGN PATENT DOCUMENTS

| | | | |
|---|---|---|---|
| 57-203576 | 12/1982 | Japan | 400/635 |

*Primary Examiner*—Christopher A. Bennett
*Attorney, Agent, or Firm*—Koda and Androlia

[57] ABSTRACT

Disclosed is a corrugated board sheet transporting system in a printing line, in which a plurality of printers, each provided with an ascendable printing cylinder having a printing die mounted thereon and a press roll opposing to the printing cylinder, are aligned in a corrugated board sheet forwarding direction. This system consists of a first feed belt unit and a second feed belt unit for holding the corrugated board sheet with the first feed belt unit, which are disposed between every adjacent two printers; the first feed belt unit consisting of a first conveyor belt which is fixed with respect to the sheet forwarding direction and a second conveyor belt which can be shifted forward and backward with respect to the sheet forwarding direction; wherein the second conveyor belt is designed to be shifted, when the printing cylinder is ascended or descended to be spaced from the press roll, to advance to a position closer to the printing cylinder in the printer. Since the first conveyor belt and the second conveyor belt are disposed to overlap partly with each other, the corrugated board sheets can stably be transferred therebetween even in the absence of the printing cylinder.

9 Claims, 5 Drawing Sheets

CORRUGATED BOARD SHEET TRANSPORTING SYSTEM IN PRINTING LINE

BACKGROUND OF THE INVENTION

This invention relates to a corrugated board sheet transporting system in a printing line in which a plurality of printers are aligned straight in the direction of forwarding corrugated board sheets.

In a corrugated board carton making machine shown in FIG. 5, a multiplicity of corrugated board sheets S cut into a predetermined length are stacked and stocked in a sheet feeding unit 31 disposed at the upstream extremity, and the sheets S are delivered from the sheet feeding unit 31 one by one toward the downstream side. Each corrugated board sheet S is printed in predetermined different colors as it is fed successively through a sheet conveyor belt 32 to a first printing unit 33, through a sheet conveyor belt 36 to a second printing unit 37, through a sheet conveyor belt 38 to a third printing unit 39, and through a sheet conveyor belt 40 to a fourth printing unit 41. The thus printed corrugated board sheet S is forwarded successively to a creaser unit 42 to be creased there, to a slotter unit 43 to be slotted there and to a die-cutting unit 44 to be cut there.

The respective units 33, 37, 39, 41, 42, 43, 44 are designed to be separable and combinable with respect to one another. The printing units 33, 37, 39, 41 of the above units 33, 37, 39, 41, 42, 43, 44 are designed to be ascended in accordance with an order change and the like so as to allow a printing cylinder 34 and a press roll 35 constituting each printing unit to be spaced upward from the processing line O of the corrugated board sheet S. It should be noted here that intermediate transportation mechanisms 45, 46, 47, 48, which can be incorporated into the processing line O when the printing cylinders 34 and the press rolls 35 are spaced from the processing line O, are disposed below the printing units 33, 37, 39, 41, respectively, so that the sheets S can be forwarded by these mechanisms incorporated instead. Incidentally, the code FL means the floor level.

More specifically, for example, provided that the second printing unit 37 and the fourth printing unit 41 need not be used in accordance with an order change from four-color printing using the four printing units to a two-color printing using only two of the printing units, the second printing unit 37 and the fourth printing unit 41 are ascended to predetermined positions so as to space the printing cylinders 34 and press rolls 35 thereof from the processing line O, while the intermediate transportation mechanisms 46 and 48 locating below the corresponding press rolls 35 are incorporated into the processing line O, and then the processing line O is actuated. Thus, corrugated board sheets S can securely be forwarded by the intermediate transportation mechanisms 46, 48 even over the zones from where the second printing unit 37 and the fourth printing unit 41 are retracted.

By the way, in such printing unit described above, a large-scaled mechanism for ascending and descending the entire printing unit and the intermediate transportation mechanism is required in order changes, and such ascending/descending mechanism costs high, disadvantageously. In addition, the positioning accuracy of the intermediate transportation mechanism when incorporated into the processing line O is lowered depending on the state of engagement of gears for connecting the mechanism to a drive source and the like, disadvantageously.

Therefore, as shown in FIG. 6, there is proposed a printer in which only the printing cylinder thereof is designed to be ascendable. In the case where a plurality of the thus constituted printers are aligned straight in the direction of forwarding corrugated board sheets S, a sheet transporting system 53 of the illustrated constitution is interposed between a printer 51 locating upstream and another printer 52 locating downstream, with respect to the sheet forwarding direction. The sheet transporting system 53 consists of a lower feed belt unit 61 and an upper feed belt unit 63, and a corrugated board sheet S is adapted to be forwarded as it is held between these two feed belt units 61, 63. The lower feed belt unit 61 consists of a conveyor belt **62*a* locating upstream and another conveyor belt 62*b* locating downstream, with respect to the sheet forwarding direction, and the front extremity (upstream extremity) of the conveyor belt 62*a* and the rear extremity (downstream extremity) of the conveyor belt 62*b* are locating adjacent to press rolls 56 of the corresponding printer 51 or 52. Meanwhile, the upper feed belt unit 63 consists of a conveyor belt 64*a* locating upstream and another conveyor belt 64*b* locating downstream, with respect to the sheet forwarding direction, and these conveyor belts 64*a*, 64*b* are adapted to be able to move forward and backward with respect to the sheet forwarding direction. Incidentally, another sheet transporting system 53 of the same constitution is also disposed on the downstream side of the downstream printer 52**.

Namely, in the upper feed belt unit 63, the conveyor belt **64*a* and the conveyor belt 64*b* are designed to be shiftable between standard positions A, i.e., the printers 51, 52 are in operation, where the rear extremity of the conveyor belt 64*a* and the front extremity of the conveyor belt 64*b* are moved closer to each other to allow the front extremity of the former and the rear extremity of the latter to locate at the positions closest to printing cylinders 55 of the corresponding printers 51, 52, respectively, as shown in FIG. 6, and advanced positions B, i.e. the downstream printer 52 is not in operation with the printing cylinder 55 thereof being ascended, where the conveyor belts 64*a*, 64*b* locating on each side of the printer 52 are advanced toward the ascended printing cylinder 55** thereof.

In the thus constituted sheet transporting system 53, for example, if the conveyor belts **64*a*, 64*b* locating on each side of the printer 52 are shifted to the advanced position, as shown in FIG. 7, when the printing cylinder 55 of the printer 52 is ascended to allow the printer 52 to assume a resting posture, corrugated board sheets S can be forwarded by the belts 64*a*, 64*b* at the position from where the printer 52** is retracted.

However, if the printing operation of the printer 52 is interrupted so as to ascend the cylinder 55 thereof for artwork replacement under the state where the printer 51 is performing printing operation, an extremity-to-extremity distance x is formed between these conveyor belts **64*a*, 64*b* locating at the advanced position with respect to the printing cylinder 55 of the printer 52; whereas another extremity-to-extremity distance y is formed between the conveyor belts 64*a*, 64*b* locating between the printers 51, 52. More specifically, since the downstream conveyor belt 64*b* is shifted to be spaced from the upstream conveyor belt 64*a* locating at the standard position in the sheet transporting system 53 disposed between these two printers 51, 52, the distance y becomes longer if the distance x is tried to be made shorter, whereas the distance x becomes longer if the distance y is tried to be made shorter. As described above, such extremity-to-extremity distance x or y is inevitably formed between the conveyor belts 64*a*, 64*b*** locating at the advanced position, or between one locating at the standard position and the other locating at the advanced position respectively, so that the corrugated board sheet S cannot be held stably over such zones corresponding to the distances x and y to allow the sheet S to flirt, and thus corrugated board sheets S tend to fail to be forwarded securely and stably.

The present invention is proposed in view of the problems described above and in order to solve them suitably, and it is an objective of the invention to provide a corrugated board sheet transporting system in a printing line which is designed to carry out stable and secured transportation of corrugated board sheets even if the printing cylinder of a printer is ascended.

SUMMARY OF THE INVENTION

In order to overcome the above problems and attain the intended object suitably, this invention provides a corrugated board sheet transporting system in a printing line, in which a plurality of printers, each provided with a printing cylinder having a printing die mounted thereon and a press roll opposing to the printing cylinder, are aligned straight in a direction of forwarding a corrugated board sheet, the printing cylinder being designed to be ascendable; the system comprising a first feed belt unit locating adjacent to the printing cylinder and a second feed belt unit, locating adjacent to the press roll, for holding the corrugated board sheet with the first feed belt unit, the first and second feed belt units being disposed between every adjacent two printers; the first feed belt unit consisting of a first conveyor belt which is fixed with respect to the sheet forwarding direction and a second conveyor belt which is designed to be shifted forward and backward with respect to the sheet forwarding direction; wherein the second conveyor belt in the first feed belt unit is designed to be shifted, when the printing cylinder is ascended or descended to be spaced from the press roll, to advance to a position closer to the printing cylinder in the printer.

Alternatively, the second conveyor belt may be designed to be shifted such that side wheels of the second conveyor belt in the first feed belt unit may be advanced, when the printing cylinder is ascended or descended to be spaced from the press roll of the corresponding printer, to a position where the wheels can oppose to the press roll.

Alternatively, the first feed belt unit may consist of a pair of first conveyor belts disposed at fixed position in the sheet forwarding direction to be spaced from each other along the width of a corrugated board sheet; and a second conveyor belt which is juxtaposed to the first conveyor belts and which can be moved forward and backward with respect to the sheet forwarding direction.

The second conveyor belt overlaps partly with the first conveyor belt in the sheet forwarding direction even when the second conveyor belt is advanced toward the printing cylinder of the printer.

Further, the second feed belt unit consists of a suction belt having a plurality of through holes formed thereon, which runs in the sheet forwarding direction; and a suction box which is disposed on the opposite side of a sheet transportation surface of the suction belt and which can suck a corrugated board sheet thereon through the through holes of the suction belt, so that the corrugated board sheet may be transported as sucked onto the transportation surface of the suction belt.

When the printing cylinder of a printer is ascended or descended to be spaced from the press roll thereof so as to carry out artwork replacement and the like in accordance with a set-up change, the second conveyor belt of the first feed belt unit is shifted to the advanced position with respect to the printing cylinder of the printer. Thus, a corrugated board sheet S can be forwarded to the printer as the sheet S is held between the first and second conveyor belts of the first feed belt unit and the second feed belt unit, and the corrugated board sheet thus fed to the printer is forwarded as it is securely held between the second conveyor belt and the press roll.

Further, since the second conveyor belt is shifted such that side wheels of the second conveyor belt in the first feed belt unit may be advanced to oppose to the press roll of the corresponding printer, the corrugated board sheet can be fed as it is more securely held between the side wheels of the second conveyor belt and the press roll. It should be noted here that since the second conveyor belts overlap partly with the first conveyor belts at the advanced position toward the printing cylinder of the printer in the sheet forwarding direction, no clearance is formed between the opposing extremities of these conveyor belts, and thus corrugated board sheets can stably be forwarded. Further, in the zone where the second feed belt unit is disposed, the corrugated board sheet can be forwarded securely as it is sucked and retained on the transportation surface of the suction belt.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

PREFERRED EMBODIMENT OF THE INVENTION

Next, the corrugated board sheet transporting system in a printing line according to this invention will be described by way of a preferred embodiment with reference to the attached drawings.

Figure 1:
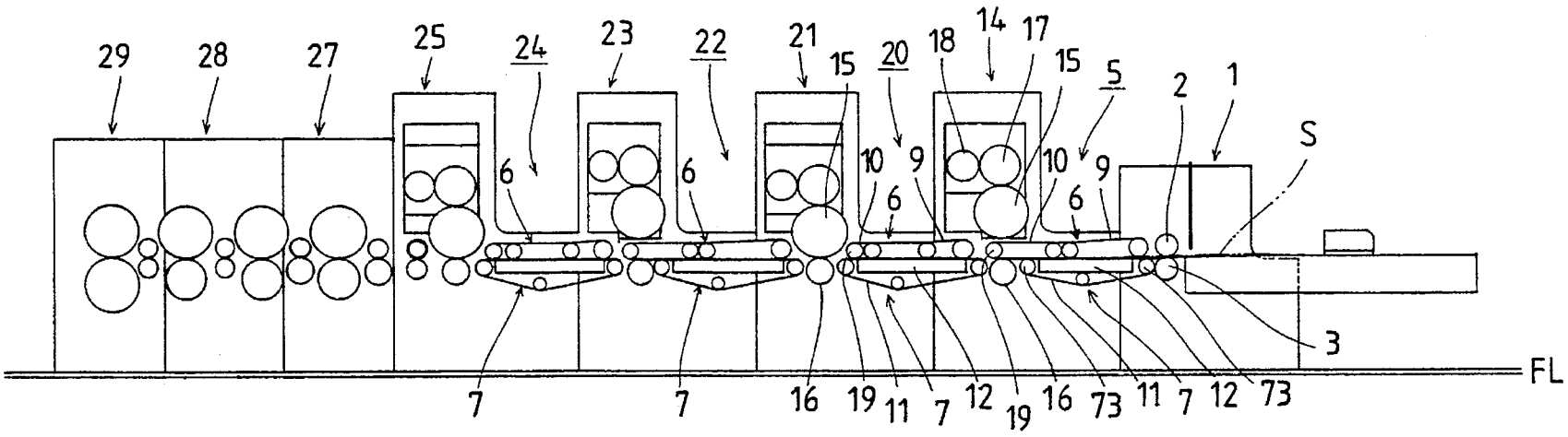
FIG. 1 is a side view of the corrugated board sheet transporting system in a printing line according to a preferred embodiment of the invention, in which the second and fourth printers are in operation and the first and third printers are not in operation.

FIG. 1 shows a side view of the corrugated board sheet transporting system according to the present invention. As illustrated, a multiplicity of corrugated board sheets S cut into a predetermined length are stacked and stored in a sheet feeding unit 1 disposed at the upstream extremity to feed the corrugated board sheets S one by one therefrom via forwarding rollers 2 and 3. And the thus fed corrugated board sheet S is forwarded to a first sheet transporting system 5. The first sheet transporting system 5 consists of an upper feed belt unit 6 and a lower feed belt unit 7, and the corrugated board sheet S is adapted to be fed to a first printer 14 (to be described later) as it is held between these units 6 and 7.

Figure 2:
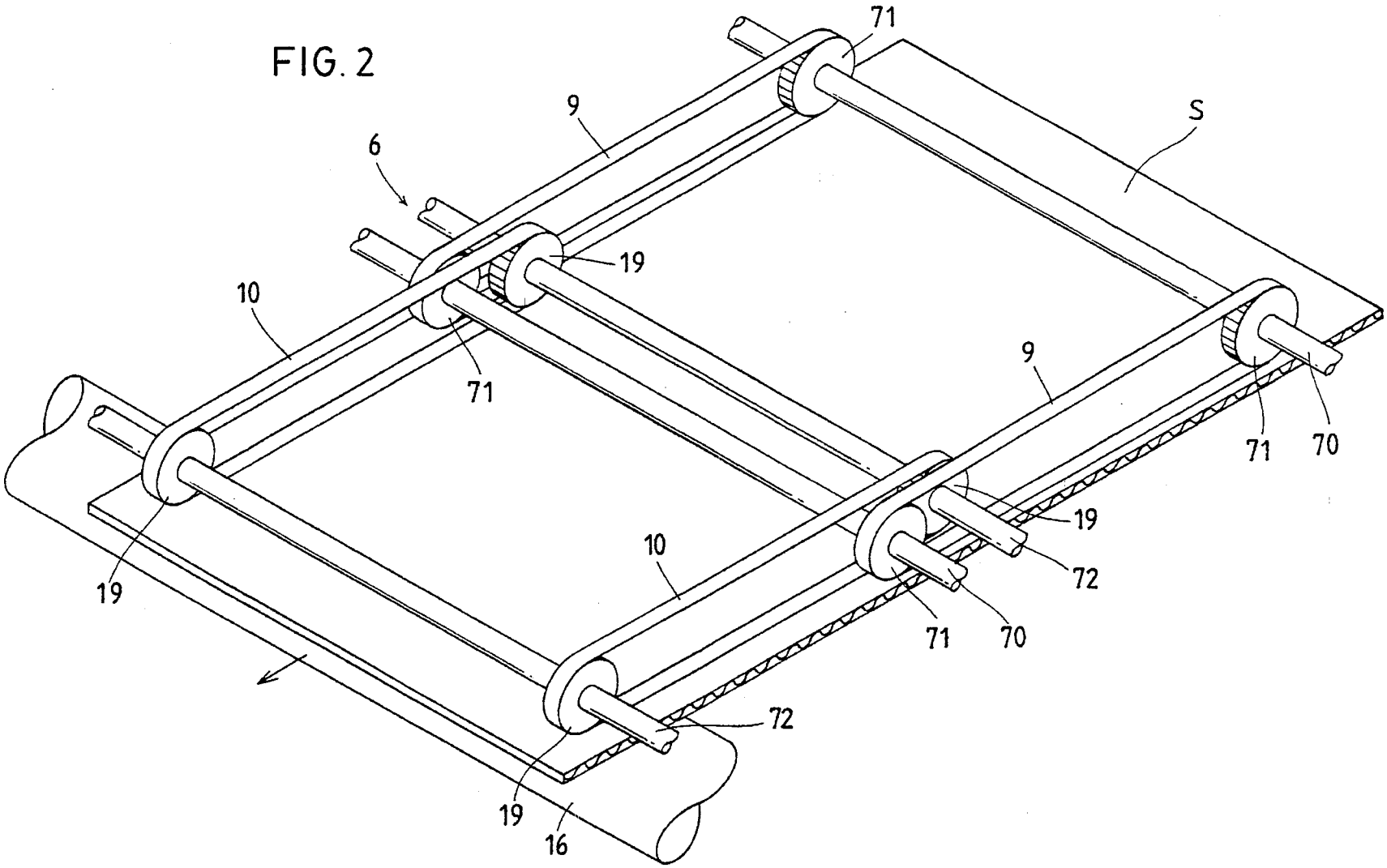
FIG. 2 is schematically in perspective view a constitution of the upper feed belt unit according to the preferred embodiment.

The upper feed belt unit 6 consists of a pair of fixed conveyor belts 9 locating at outer positions with respect to the direction orthogonal to the sheet forwarding direction (along the width of the corrugated board sheet S) and a pair of movable conveyor belts 10 disposed at the positions inner than the fixed conveyor belts 9, and each pair of belts 9 or 10 are spaced from each other in the direction orthogonal to the sheet forwarding direction. Namely, as shown in FIG. 2, a pair of fixed shafts 70 are disposed to be spaced parallelwise from each other in the sheet forwarding direction, and a pair of wheels 71 are fitted on each fixed shaft 70 to be spaced from each other in the axial direction, with a fixed conveyor belt 9 being extended across each pair of wheels 71 opposing to each other in the sheet forwarding direction. Meanwhile, a pair of movable shafts 72 are disposed to be spaced parallelwise from each other in the sheet forwarding direction, and a pair of wheels 19 are fitted on each movable shaft 72 to be spaced from each other in the axial direction, with a movable conveyor belt 10 being extended across each pair of wheels 19 opposing to each other in the sheet forwarding direction. It should be noted here that the upstream movable shaft 72 is located more upstream than the downstream fixed shaft 70, with respect to the sheet forwarding direction, while the movable conveyor belts 10 extended across the respective pairs of wheels 19 are located within the corresponding fixed conveyor belts 9.

The movable shafts 72 are designed to be shifted forward or backward with respect to the sheet forwarding direction by a moving mechanism such as an air cylinder (not shown) so that the movable conveyor belts 10 may be positioned at the standard position (FIG. 3) where they are spaced upstream from the press roll 16 of the printer 14 and at the advanced position (FIG. 4) where they are locating above the press roll 16. It should be noted here that the wheels 19 fitted to the downstream movable shaft 72 are adapted to locate above the press roll 16 when the movable conveyor belts 10 are shifted to the advanced position. Meanwhile, the upstream parts of the movable conveyor belts 10 locating at the advanced position are designed to overlap with the downstream parts of the fixed conveyor belts 9 over a predetermined length in the sheet forwarding direction.

Incidentally, the fixed conveyor belts 9 and the movable conveyor belts 10 in the upper feed belt unit 6 are designed to be shiftable along the width of a corrugated board sheet forwarded thereto depending on the size thereof, so that the corrugated board sheet S may securely be held at each side portion thereof between the fixed and movable belts and the lower feed belt unit 7. The belts 9, 10 are designed to be positioned automatically at such position as will not smear the printed patterns and can feed the corrugated board sheet S.

The lower feed belt unit 7 consists of a multiplicity of suction belts 11 extended parallelwise across a plurality of rollers 73 disposed to be spaced from one another in the sheet forwarding direction, with a suction box 12 connected to a suction source (not shown) being disposed under the upper transportation surfaces of the suction belts 11. A multiplicity of through holes are drilled on the upper surface of the suction box 12, so that a suction force may be exerted on the upper surfaces (transportation surfaces) of the suction belts 11 through the through holes of the suction box 12 and a multiplicity of through holes formed on the suction belts 11 by generating a negative pressure in the suction box 12. Thus, the corrugated board sheet S forwarded by the forwarding rollers 2, 3 to the suction belts 11 of the lower feed belt unit 7 is sucked to be securely retained onto the transportation surfaces of the suction belts 11 under the sucking action exerted thereto. Incidentally, the multiplicity of suction belts 11 may be replaced by one broad suction belt extended across the plurality of rollers 73.

The fixed conveyor belts 9, the movable conveyor belts 10 and the suction belts 11 serve as timing belts which are driven by the same driving system, so that the peripheral speeds of these belts may not be changed.

The first printer 14, which is disposed downstream than the first sheet transporting system 5 with respect to the sheet forwarding direction, is provided with a printing cylinder 15 and a press roll 16 arranged in a vertical relationship such that the printing cylinder 15 may locate above the press roll 16, and a corrugated board sheet is designed to be forwarded as it is held between the printing cylinder 15 and the press roll 16 to a second sheet transporting system 20 disposed downstream, as well as, to carry out predetermined printing. The printing cylinder 15, which is designed to be ascendable, is adapted to be descended to a printing position where the corrugated board sheet S is pressed against the press roll 16 and ascended to a non-printing position where the cylinder 15 is spaced upward from the press roll 16. The corrugated board sheet S forwarded to the second sheet transporting system 20 is fed to a second printer 21. The reference numbers 17 and 18 denote an anilox roller and a squeezing roller, respectively.

The corrugated board sheet S printed in the second printer 21 is then forwarded to a third printer 23 by a third sheet transporting system 22, and the sheet S printed in the third printer 23 is forwarded to a fourth printer 25 by a fourth sheet transporting system 24 to be subjected to printing. The corrugated board sheet S printed through these four printers 14, 21, 23, 25 is forwarded successively to a creaser unit 27 to be creased there, a slotter unit 28 to be slotted there and a die-cutting unit 29 to be cut there. Incidentally, the constitution of the second sheet transporting system 20, that of the third sheet transporting system 22 and that of the fourth sheet transporting system 24 are the same as that of the first sheet transporting system 5; and the constitution of the second printer 21, that of the third printer 23 and that of the fourth printer 25 are the same as that of the first printer 14.

Figure 3:
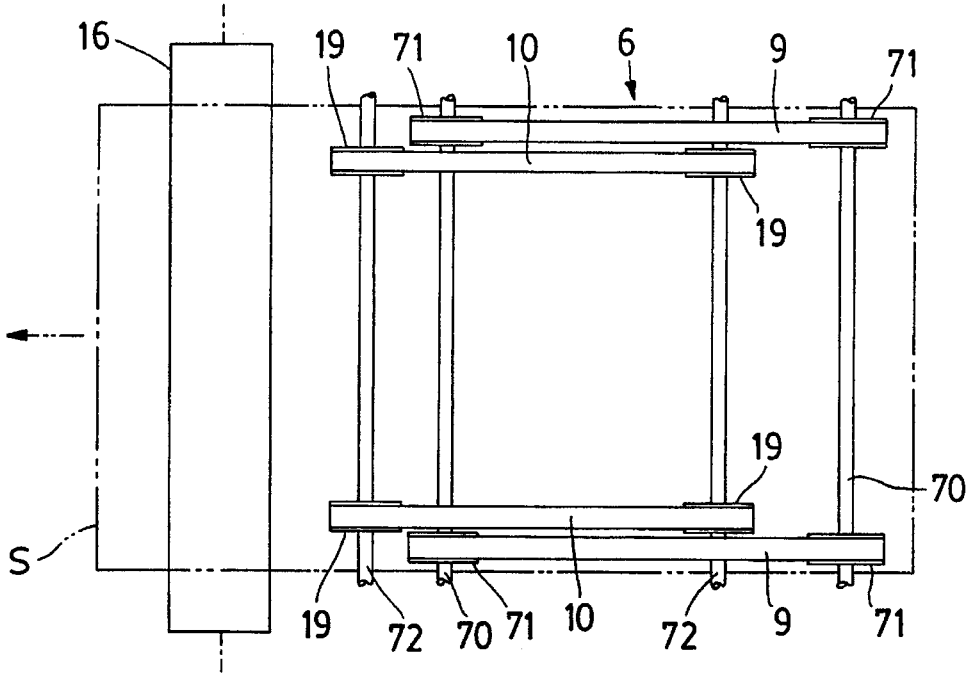
FIG. 3 is an explanatory plan view of the upper feed belt unit according to the preferred embodiment, in which movable conveyor belts of the upper feed belt unit are positioned at the standard position.

Next, the operation of the thus constituted transporting system according to the preferred embodiment of the invention will be described taking an example of a case where printing is to be carried out using the second printer 21 and the fourth printer 25. Namely, in the second printer 21 and the fourth printer 25, the printing cylinders 15 are descended to be positioned at the printing position where they can hold a corrugated board sheet S with the corresponding press rolls 16, as shown in FIG. 1. On the other hand, in the second sheet transporting system 20 and the fourth sheet transporting system 24, the movable conveyor belts 10 of the corresponding upper feed belt units 6 are shifted upstream from the advanced positions above the press rolls 16 to the standard position, respectively, with respect to the sheet forwarding direction, as shown in FIG. 3.

Figure 4:
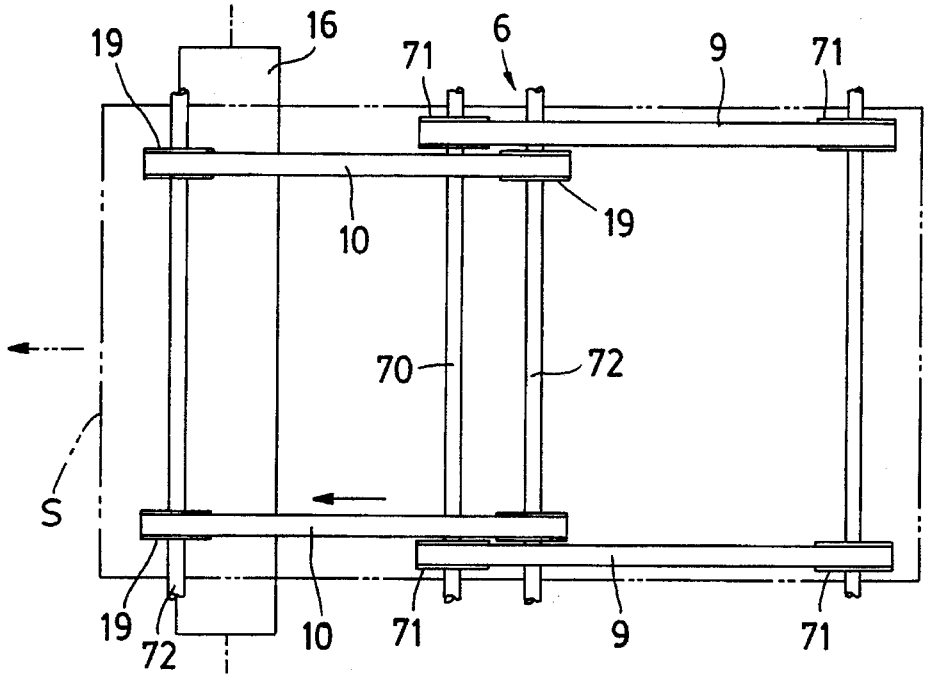
FIG. 4 is an explanatory plan view of the upper feed belt unit according to the preferred embodiment, in which the movable conveyor belts of the upper feed belt unit are positioned at the advanced position.
Figure 5:
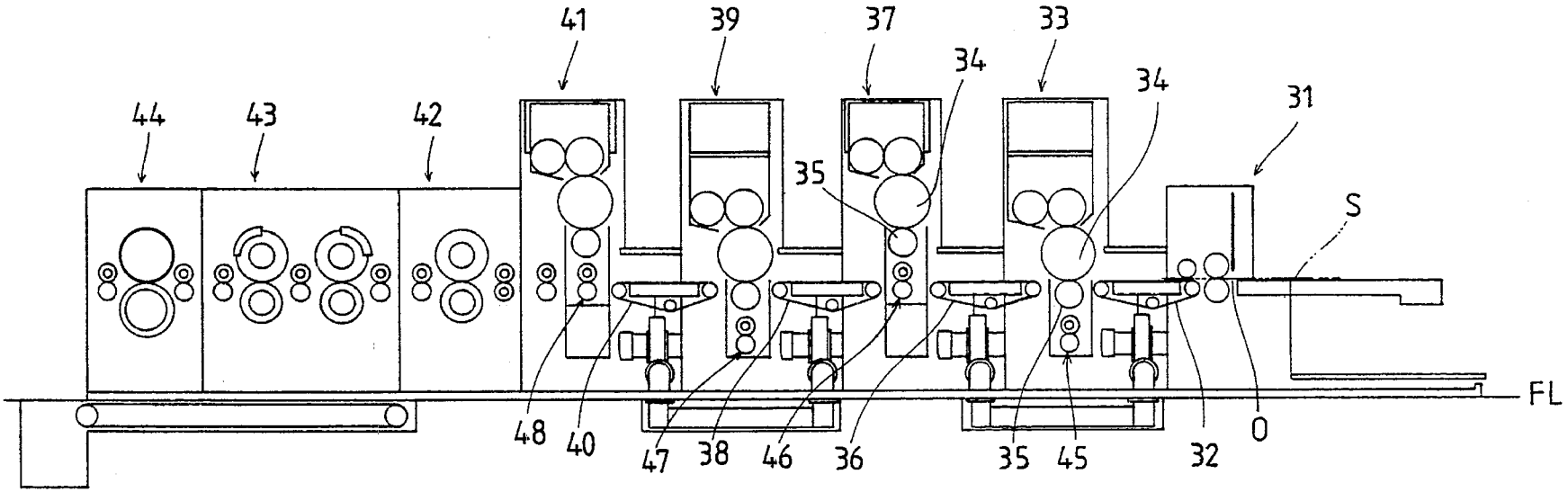
FIG.5 PRIOR ART
FIG. 5 is a side view of the prior art corrugated board sheet transporting system in a printing line, in which the printing units are designed to be ascended or descended.
Figure 6:
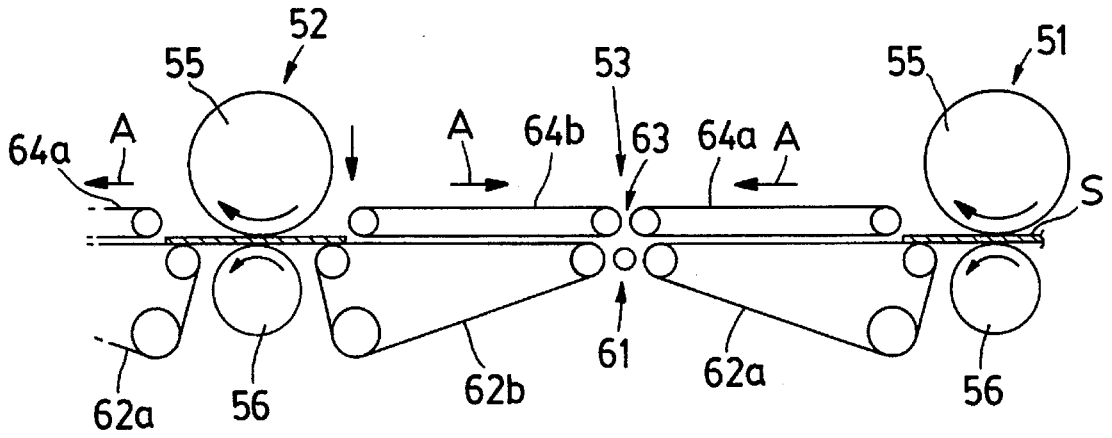
FIG. 6 PRIOR ART
FIG. 6 is a side view of the prior art corrugated board sheet transporting system in a printing line having conveyor belts which are designed to be shiftable forward or backward with respect to the sheet forwarding direction, showing two printers in operation.
Figure 7:
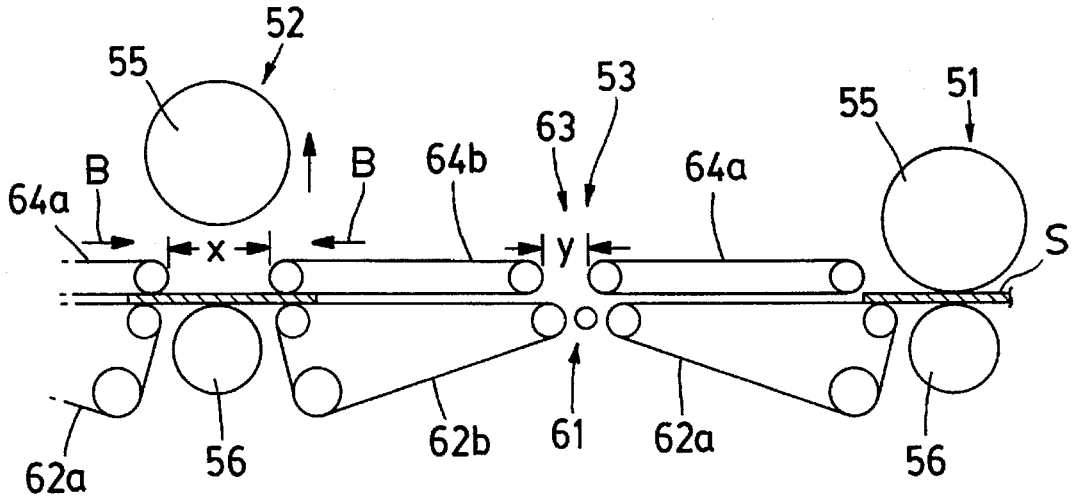
FIG. 7 PRIOR ART
FIG. 7 is a side view of the prior art corrugated board sheet transporting system in a printing line having conveyor belts which are designed to be shiftable forward or backward with respect to the sheet forwarding direction, showing one printer in operation and the other not in operation.

Meanwhile, in the first printer 14 and the third printer 23, which are assuming resting postures for artwork replacement and the like in accordance with a set-up change, the corresponding printing cylinders 15 are ascended by hydraulic systems to be spaced upward from the corresponding press rolls 16 and positioned at non-printing positions, respectively. On the other hand, in the first sheet transporting system 5 and the third sheet transporting system 22, the movable belts 10 of the corresponding upper feed belt units 6 are shifted downstream, after confirmation of the ascending of the corresponding printing cylinders 15, by air cylinders with respect to the sheet forwarding direction to allow the corresponding toothed wheels 19 to locate at the advanced positions above the corresponding press rolls 16, respectively, as shown in FIG. 4.

If the printing line is actuated in this state, a corrugated board sheet S fed from the sheet feeding unit 1 via the forwarding rollers 2, 3 to the first sheet transporting system 5 is forwarded downstream as it is held between the fixed conveyor belts 9 of the upper feed belt unit 6 and the suction belts 11 of the lower feed belt unit 7. In the first printer 14, the corrugated board sheet S is forwarded stably toward the second sheet transporting system 20 as the sheet S is held between the press roll 16 and the toothed wheels 19 of the movable conveyor belts 10 without being subjected to printing. Incidentally, since the corrugated board sheet S is sucked and retained on the transportation surfaces of the suction belts 11 in the zone where the lower feed belt unit 7 is disposed, secured forwarding of the sheet S can be achieved.

The corrugated board sheet S fed to the second sheet transporting system 20 is then forwarded to the second printer 21 as the sheet S is held between the fixed and movable conveyor belts 9, 10 of the upper feed belt unit 6 and the suction belts 11 of the lower feed belt unit 7. The corrugated board sheet S is fed between the printing cylinder 15 and the press roll 16 of the second printer 21 to be subjected to predetermined printing and also forwarded downstream as it is held between the printing cylinder 15 and the press roll 16.

The corrugated board sheet S fed to the third sheet transporting system 22 from the second printer 21 is forwarded downstream as the sheet S is held between the fixed conveyor belts 9 of the upper feed belt unit 6 and the suction belts 11 of the lower feed belt unit 7. In the third printer 23, the corrugated board sheet S is forwarded stably toward the fourth sheet transporting system 24 as the sheet S is held between the press roll 16 and the toothed wheels 19 of the movable conveyor belts 10 without being subjected to printing. Further, the corrugated board sheet S forwarded to the fourth sheet transporting system 24 is fed to the fourth printer 25 as the sheet S is held between the fixed and movable conveyor belts 9, 10 of the upper feed belt unit 6 and the suction belts 11 of the lower feed belt unit 7. The thus treated corrugated board sheet S is fed between the printing cylinder 15 and the press roll 16 of the fourth printer 25 to be subjected to predetermined printing and also forwarded downstream as it is held between the printing cylinder 15 and the press roll 16.

As described above, corrugated board sheets S can stably and securely be forwarded in the first sheet transporting system 5 attached to the first printer 14 and in the third sheet transporting system 22 attached to the third printer 23, which are assuming resting postures, by allowing the toothed wheels 19 of the movable belts 10 in the corresponding feed belt units 6 to locate above the corresponding press rolls 16, as shown in FIG. 4. Besides, even when the movable conveyor belts 10 are shifted to the advanced positions, the upstream extremities thereof overlap with the downstream extremities of the fixed conveyor belts 9 over a predetermined length in the sheet forwarding direction, so that the corrugated board sheets S can stably be transferred from the downstream extremities of the fixed movable belts 9 to the upstream extremities of the movable conveyor belts 10. In the first and third printers 14 and 23 which are assuming resting postures, replacement of the artworks of the printing cylinders 15 can be carried out by operators.

In other words, corrugated board sheets S can be transferred smoothly with the aid of the fixed conveyor belts 9 and the movable conveyor belts 10 of the upper feed belt units 6 from the sheet transporting systems to the printers, respectively. In addition, if the printing cylinders of some printers are ascended for artwork replacement and the like in accordance with a set-up change, the corresponding movable conveyor belts 10 are shifted so as to allow the toothed wheels 19 thereof to locate above the corresponding press rolls, so that the corrugated board sheet S can be forwarded as it is held securely between the press roll 16 and the toothed wheels 19 of the movable conveyor belts 10, preventing flirting of the sheets S in those printers which are assuming resting postures.

It should be noted that, while the printing cylinders 15 are designed to be shifted upward from the printing line in the embodiment described above, the present invention is not limited to such embodiment, and that the printing cylinders 15 may be designed to be shifted downward from the printing line. In such case, the upper feed belt units 6 and the lower feed belt units 7 are adapted to be disposed below and above the printing line, respectively. While the movable conveyor belts 9 are designed to be shifted downstream with respect to the sheet forwarding direction in the embodiment described above, the belts 9 may be designed to be shifted upstream with respect to the sheet forwarding direction. Further, the lower feed belt units 7 may not be limited to the suction belts 11, and it is of course possible to employ belts of other systems. Moreover, it is recommended that the wheels 19 in each upper feed belt unit 6 are designed to have a thickness sufficiently greater than the width of the movable conveyor belts 10, so that the corrugated board sheets S may securely be held between the wheels 19 and the press roll 16.

What is claimed is:

1. A corrugated board sheet transporting system in a printing line, in which a plurality of printers, each provided with a printing cylinder having a printing die mounted thereon and a press roll opposing to said printing cylinder, are aligned straight in a direction of forwarding a corrugated board sheet, said printing cylinder being designed to be ascendable;

said system comprising a first feed belt unit located adjacent to said printing cylinder and a second feed belt unit located adjacent to said press roll for holding said corrugated board sheet with said first feed belt unit, said first and second feed belt units being disposed between every adjacent two printers; said first feed belt unit comprising a first conveyer belt which is fixed with respect to the sheet forwarding direction and a second conveyor belt which is shiftable forward and backward with respect to the sheet forwarding direction; means for shifting said second conveyor belt forward and backward; and wherein said second conveyor belt in said first feed belt unit is shifted when said printing cylinder is ascended or descended to be spaced from said press roll, to advance to a position closer to said printing cylinder in said printer and said second conveyor belt partially overlaps with said first conveyor belt in the sheet forwarding direction.

2. A corrugated board sheet transporting system in a printing line according to claim 1, wherein said second conveyor belt further comprises side wheels and said second conveyor belt is shifted such that said side wheels of said second conveyor belt in said first feed belt unit are advanced, when said printing cylinder is ascended or descended to be spaced from said press roll of the corresponding printer, to a position where said wheels oppose said press roll.

3. The corrugated board sheet transporting system in a printing line according to claim 1 or 2, wherein said first feed belt unit further comprises another first conveyor belt forming a pair of first conveyor belts disposed at a fixed position in the sheet forwarding direction and spaced from each other along the width of a corrugated board sheet; and a second conveyor belt which is juxtaposed to said pair of said first conveyor belts and which is shiftable forward and backward with respect to the sheet forwarding direction.

4. The corrugated board sheet transporting system in a printing line according to any of claims 1 to 2, wherein said second feed belt unit comprises a suction belt having a plurality of through holes formed thereon, which runs in the sheet forwarding direction; and a suction box which is disposed on the opposite side of a sheet transportation surface of said suction belt and which can suck a corrugated board sheet thereon through said through holes of said suction belt, so that said corrugated board sheet may be transported sucked onto said transportation surface of said suction belt.

5. The corrugated board sheet transporting system in a printing line according to claim 3, wherein said second feed belt unit comprises a suction belt having a plurality of through holes formed thereon, which runs in the sheet forwarding direction; a suction box which is disposed on the opposite side of the sheet transporting surface of the suction belt and which can suck a corrugated board sheet thereon through said through holes of said suction belt, so that said corrugated board sheet is transported sucked onto said transportation surface of said suction belt.

6. A corrugated board sheet transporting system comprising a multiplicity of printers, each comprising a press roll which is provided below a transportation path of a corrugated board sheet and a print cylinder provided above said transporting path so as to be ascended and descended, said multiplicity of printers being disposed with a predetermined space in between in a direction of forwarding said corrugated board sheet, a first feed belt unit being provided on said print cylinder side of said transportation path and a second feed belt unit being provided on said press roll side of said transportation path, said first feed belt unit being comprised of a first conveyor belt which is positionally immovable in said sheet forwarding direction and a second conveyor belt which is positionally shiftable forwardly and backwardly in said sheet forwarding direction so that said corrugated board sheet is held and transported by said first and second conveyor belts and said second feed belt unit, and wherein an upstream end of said second conveyor belt in said sheet forwarding direction stays on an upstream side of a downstream end of said immovable first conveyor belt when said shiftable second conveyor belt is shifted forward and backward in said sheet forwarding direction; and no clearance is formed between said second conveyor belt and said first conveyor belt even when said print cylinder is ascended to be spaced from said press roll and said second conveyor belt is moved to under said print cylinder.

7. A corrugated board sheet transporting system according to claim 6, wherein a downstream end of said second conveyor belt in said sheet advancing direction is shifted to a position to face said press roll of each of said printers, when said print cylinder is ascended so as to be spaced from said press roll and said second conveyor belt is moved to under said ascended print cylinder.

8. A corrugated board sheet transporting system comprising a multiplicity of printers, each comprising a press roll which is provided above a transportation path of a corrugated board sheet and a print cylinder provided below said transporting path so as to be ascended and descended, said multiplicity of printers being disposed with a predetermined space in between in a direction of forwarding said corrugated board sheet, a first feed belt unit being provided on said print cylinder side of said transportation path and a second feed belt unit being provided on said press roll side of said transportation path, said first feed belt unit being comprised of a first conveyor belt which is positionally immovable in said sheet forwarding direction and a second conveyor belt which is positionally shiftable forwardly and backwardly in said sheet forwarding direction so that said corrugated board sheet is held and transported by said first and second conveyor belts and said second feed belt unit, and wherein an upstream end of said second conveyor belt in said sheet forwarding direction stays on an upstream side of a downstream end of said immovable first conveyor belt when said shiftable second conveyor belt is shifted forward and backward in said sheet forwarding direction; and no clearance is formed between said second conveyor belt and said first conveyor belt even when said print cylinder is descended to be spaced from said press roll and said second conveyor belt is moved to above said print cylinder.

9. A corrugated board sheet transporting system according to claim 8, wherein a downstream end of said second conveyor belt in said sheet advancing direction is shifted to a position to face said press roll of each of said printers, when said print cylinder is descended so as to be spaced from said press roll and said second conveyor belt is moved to above said descended print cylinder.

* * * * *

UNITED STATES PATENT AND TRADEMARK OFFICE

CERTIFICATE OF CORRECTION

PATENT NO. : 5,562,032

DATED : October 8, 1996

INVENTOR(S) : Kazumi Hasegawa, et al.

It is certified that error appears in the above-indentified patent and that said Letters Patent is hereby corrected as shown below:

TITLE PAGE:

Item [22] Filed:

Change "Dec. 6, 1993" to --Nov. 29, 1994--

Add:

--[30] Foreign Application Priority Data:

December 6, 1993 [JP] Japan ..... 5-305263--

Signed and Sealed this

Fifth Day of August, 1997

Bruce Lehman

*Attest:*

BRUCE LEHMAN

*Attesting Officer*

*Commissioner of Patents and Trademarks*